US012221255B2

(12) United States Patent
Kim et al.

(10) Patent No.: US 12,221,255 B2
(45) Date of Patent: Feb. 11, 2025

(54) PACKAGE BOX ASSEMBLY COMPRISING HANGER

(71) Applicant: Samsung Electronics Co., Ltd., Suwon-si (KR)

(72) Inventors: Sanghyun Kim, Suwon-si (KR); Kwangchul Park, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 50 days.

(21) Appl. No.: 18/359,265

(22) Filed: Jul. 26, 2023

(65) Prior Publication Data

US 2023/0365295 A1 Nov. 16, 2023

Related U.S. Application Data

(63) Continuation of application No. PCT/KR2022/000344, filed on Jan. 10, 2022.

(30) Foreign Application Priority Data

Feb. 10, 2021 (KR) ..... 10-2021-0019081

(51) Int. Cl.
*B65D 5/52* (2006.01)
*B65D 5/42* (2006.01)

(52) U.S. Cl.
CPC ..... *B65D 5/52* (2013.01); *B65D 5/4208* (2013.01)

(58) Field of Classification Search
CPC ..... B65D 5/52; B65D 5/4208; B65D 5/5206; B65D 5/5213; B65D 5/5286; B65D 15/22
(Continued)

(56) References Cited

U.S. PATENT DOCUMENTS 3,380,575 A 4/1968 Hennessey
4,347,930 A * 9/1982 Herrin ..... B65D 5/4208 229/117.19

(Continued)

FOREIGN PATENT DOCUMENTS

CN 111348293 A 6/2020
JP 08-198244 A 8/1996

(Continued)

OTHER PUBLICATIONS

International Search Report dated Apr. 22, 2022, issued in International Application No. PCT/KR2022/000344.

*Primary Examiner* — Luan K Bui
(74) *Attorney, Agent, or Firm* — Jefferson IP Law, LLP

(57) ABSTRACT

A package box assembly is provided. The package box assembly includes a first box comprising an accommodation portion defined by a plate and a side wall disposed to surround the plate along the periphery of the plate and having a designated height, a second box accommodated in the accommodation portion, a hanger disposed in a first space of the accommodation portion to protrude through an opening formed in the side wall, an elastic member disposed in the first space to press the hanger toward the opening, and a sealing member removably disposed on the side wall to seal the opening. The hanger is accommodated in the first space while being pushed by pressure from the elastic member. In case that the sealing member is removed, the hanger at least partially protrudes to the outside of the first box via the opening by the pushing force of the elastic member.

20 Claims, 12 Drawing Sheets

(58) Field of Classification Search
USPC ..... 206/45.24, 461, 736, 738, 767, 806
See application file for complete search history.

(56) References Cited

U.S. PATENT DOCUMENTS

| | | | | |
|---|---|---|---|---|
| 4,349,102 | A * | 9/1982 | Strongwater | B65D 25/22 206/45.24 |
| 4,632,242 | A | 12/1986 | Choi et al. | |
| 6,589,622 | B1 | 7/2003 | Scott | |
| 7,257,916 | B2 * | 8/2007 | Hall | G09F 23/00 5/636 |
| 8,955,671 | B1 * | 2/2015 | Barnett | B65D 11/12 206/806 |
| 9,186,453 | B1 | 11/2015 | Russell | |
| 10,689,175 | B1 | 6/2020 | Mundt | |
| 2011/0096523 | A1 | 4/2011 | Li et al. | |
| 2013/0277420 | A1 * | 10/2013 | Valencia | B65D 5/427 229/117.18 |
| 2014/0097122 | A1 * | 4/2014 | Patterson | B65D 5/5226 229/242 |

FOREIGN PATENT DOCUMENTS

| | | | |
|---|---|---|---|
| JP | 11-165768 | A | 6/1999 |
| JP | 2005-119678 | A | 5/2005 |
| JP | 2006-232361 | A | 9/2006 |
| KR | 20-0322578 | Y1 | 8/2003 |
| KR | 10-2015-0112213 | A | 10/2015 |
| KR | 20-0480624 | Y1 | 6/2016 |

* cited by examiner

PACKAGE BOX ASSEMBLY COMPRISING HANGER

CROSS-REFERENCE TO RELATED APPLICATION(S)

This application is a continuation application, claiming priority under § 365(c), of an International application No. PCT/KR2022/000344, filed on Jan. 10, 2022, which is based on and claims the benefit of a Korean patent application number 10-2021-0019081, filed on Feb. 10, 2021, in the Korean Intellectual Property Office, the disclosure of which is incorporated by reference herein in its entirety.

BACKGROUND

1. Field

The disclosure relates to a package box assembly that includes a hanger.

2. Description of Related Art

Various products such as electronic devices may be packaged in a package box and then distributed. A package box may hang on a stall or exhibition stand located at a designated place for the purpose of selling or displaying an electronic device. In this case, the package box may include a loop-shaped hanger and may hang on a stall with the hanger to be displayed. In order to reduce material costs and distribution costs, it is necessary to reduce the loading space of multiple package boxes as much as possible during logistics movement and palletizing.

The above information is presented as background information only to assist with an understanding of the disclosure. No determination has been made, and no assertion is made, as to whether any of the above might be applicable as prior art with regard to the disclosure.

SUMMARY

In general, a package box may include a box body configured to package various products (e.g., electronic devices), and a hanger configured to hang the package box on a stall or exhibition stand for the purpose of displaying and selling. This hanger may include a hanging portion that may protrude outward from the package box.

However, during logistics movement and palletizing of these package boxes, unnecessary dead space may be generated due to hangers protruding from the box bodies, and due to this dead space, the number of package boxes accommodated per unit carton may decrease or the volume of the package boxes may increase, resulting in an increase in logistics costs or manufacturing costs. In addition, unlike the package boxes, the hangers are mainly made of a synthetic resin (e.g., plastic), which may go against eco-friendly conditions.

Aspects of the disclosure are to address at least the above-mentioned problems and/or disadvantages and to provide at least the advantages described below. Accordingly, an aspect of the disclosure is to provide a package box assembly including a hanger that is capable of helping reduce logistics costs and manufacturing costs by improving loading efficiency.

Another aspect of the disclosure is to provide a package box assembly including a hanger made of an eco-friendly material.

Additional aspects will be set forth in part in the description which follows and, in part, will be apparent from the description, or may be learned by practice of the presented embodiments.

In accordance with an aspect of the disclosure, a package box assembly is provided. The package box assembly includes a first box including an accommodation portion defined by a plate and a side wall disposed to surround the plate along the periphery of the plate and having a predetermined height, a second box at least partially accommodated in the accommodation portion, a hanger disposed in a first space in the accommodation portion to at least partially protrude through an opening provided in the side wall, an elastic member disposed in the first space to press the hanger toward the opening, and a sealing member removably disposed on the side wall to seal the opening. The hanger may be accommodated in the first space through the sealing member while being pushed by pressure from the elastic member, and in case that the sealing member is removed, the hanger may at least partially protrude to the outside of the first box through the opening by the pushing force of the elastic member.

With the package box according to an embodiment of the disclosure, since the hanger disposed to be pushed by the elastic member in at least a portion of the inner space is prevented from protruding through a detachable sealing member disposed outside, loading efficiency may be improved, manufacturing costs may be reduced, and since the hanger protrudes through removal of the sealing member when used, convenience of use may be improved.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features, and advantages of certain embodiments of the disclosure will be more apparent from the following description taken in conjunction with the accompanying drawings, in which.

The same reference numerals are used to represent the same elements throughout the drawings.

DETAILED DESCRIPTION

The following description with reference to the accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

In the disclosure, the package box assembly is described as being configured through the assembly of a first box and a second box, but the disclosure is not limited thereto. For example, the disclosure is also applicable to a single box structure including a hanger disposed to protrude from an inner space.

Figure 1A:
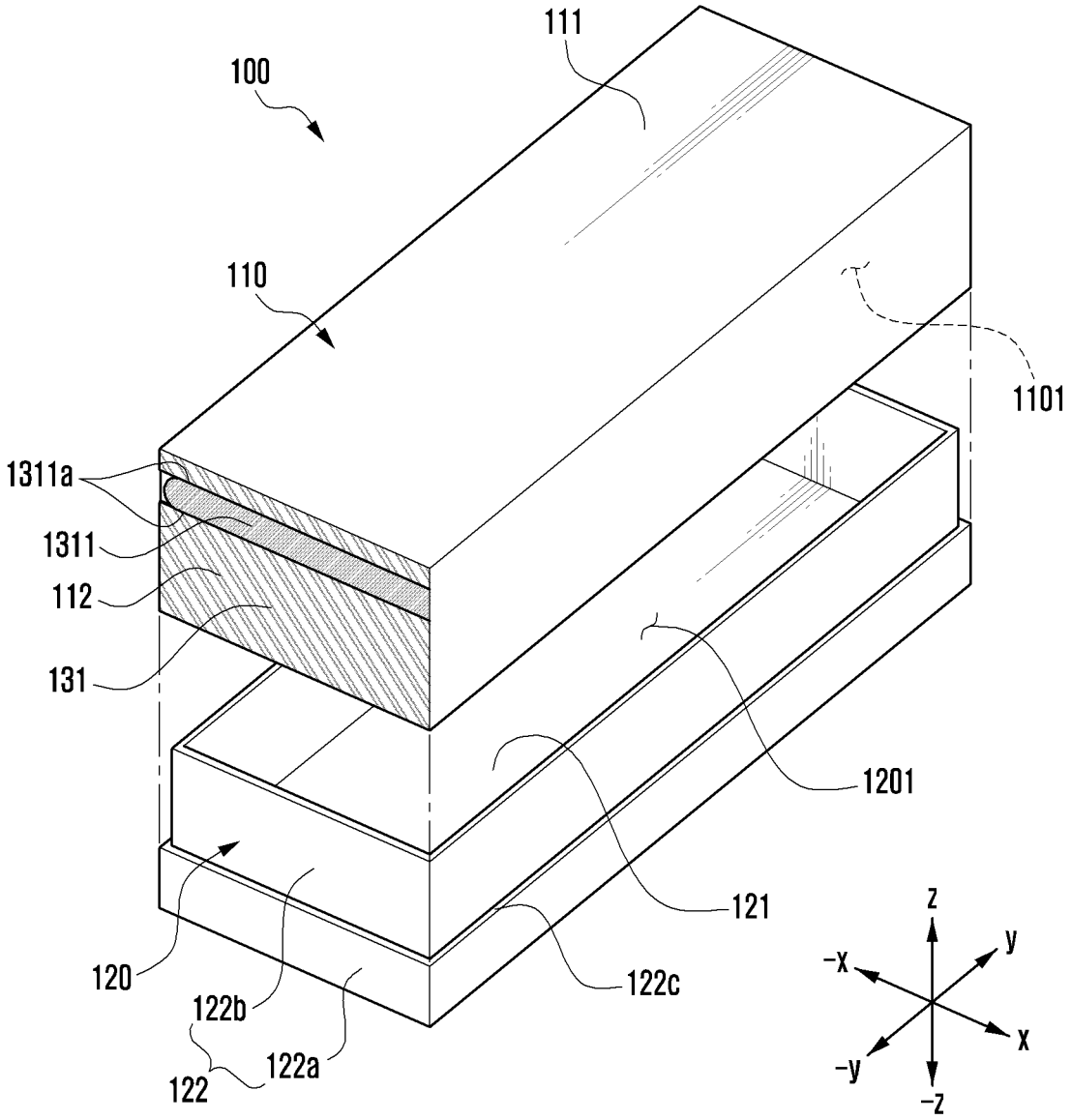
FIG. 1A is a perspective view of a package box assembly according to an embodiment of the disclosure.
Figure 1B:
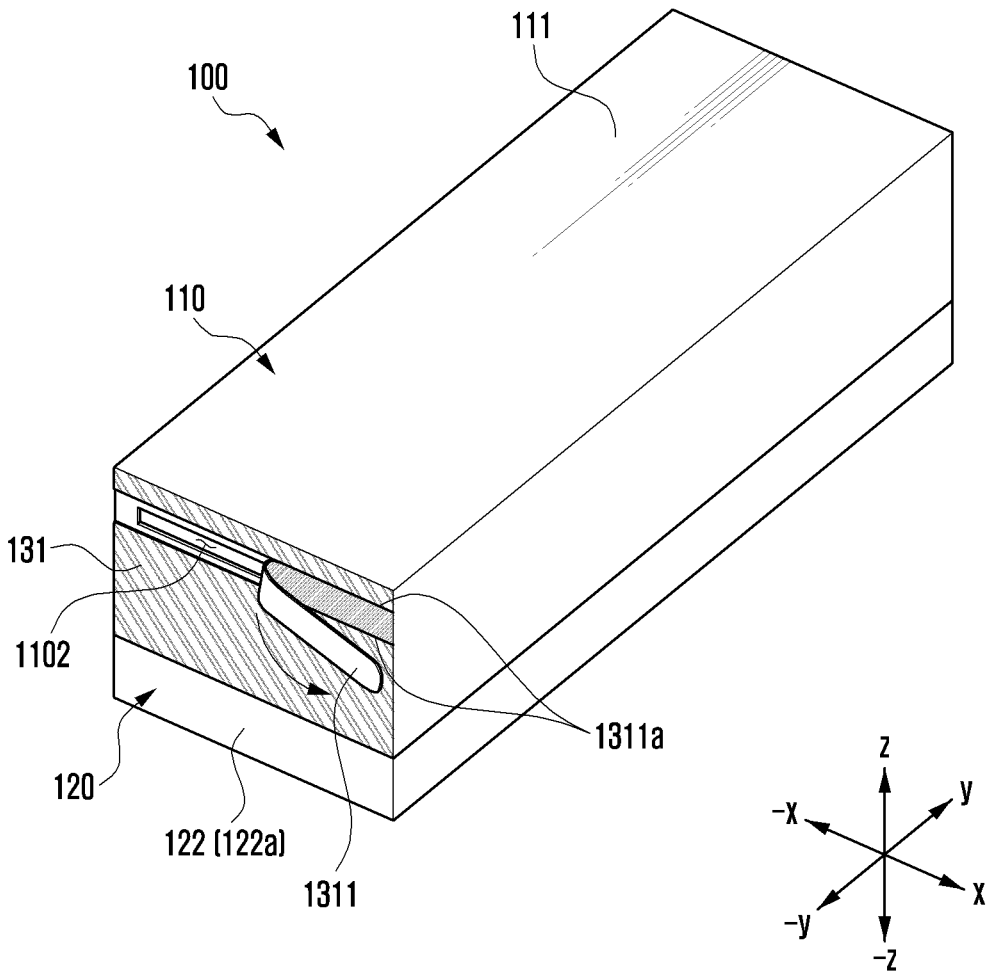
FIG. 1B is a view illustrating a state in which an opening is exposed through removal of a sealing member according to an embodiment of the disclosure.
Figure 1C:
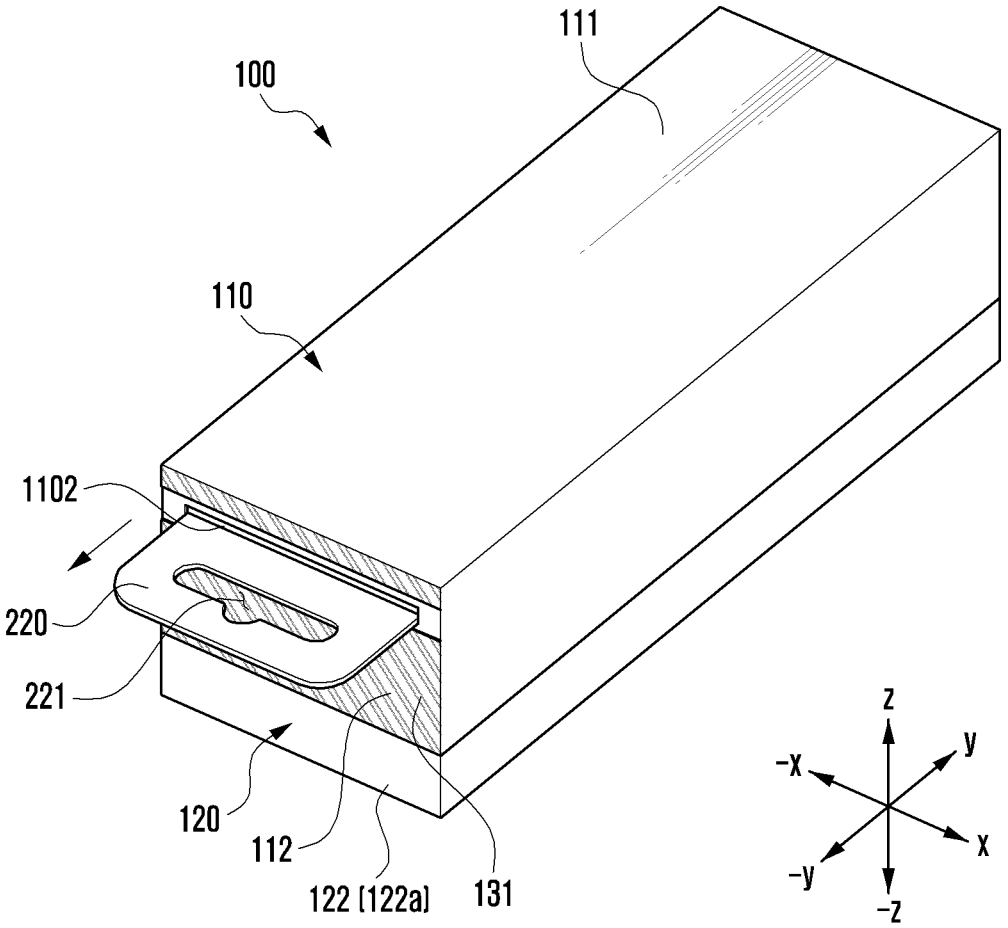
FIG. 1C is a view illustrating a state in which a hanger protrudes through the opening according to an embodiment of the disclosure.

FIG. 1A is a perspective view of a package box assembly according to an embodiment of the disclosure. FIG. 1B is a view illustrating a state in which an opening is exposed through removal of a sealing member according to an embodiment of the disclosure. FIG. 1C is a view illustrating a state in which a hanger protrudes through the opening according to an embodiment of the disclosure.

Referring to FIGS. 1A to 1C, a package box assembly 100 may include a first box 110 and a second box 120 at least partially coupled to the first box 110 and configured to define a space for packaging a product such as an electronic device. According to an embodiment, the first box 110 may include a first plate 111 and a first side wall 112 disposed along the periphery of the first plate 111 and having a predetermined height. According to an embodiment, the first box 110 may include a first accommodation portion 1101 defined by the first plate 111 and the first side wall 112 to accommodate at least a portion of the electronic device. According to an embodiment, the first box 110 may be fabricated in a manner in which at least two sheets of paper are laminated, punched out in the form of a spread sheet, and then folded.

According to various embodiments, the second box 120 may include a second plate 121 and a second side wall 122 disposed along the periphery of the second plate 121 and having a predetermined height. According to an embodiment, the second side wall 122 may include a first portion 122*a* and a second portion 122*b* extending from the first portion 122*a* and configured to be narrower than the first portion 122*a* due to an engagement step 122*c*. According to an embodiment, the second box 120 may include a second accommodation portion 1201 defined by the second plate 121 and the second side wall 122 to accommodate at least a portion of the electronic device. According to an embodiment, when the first box 110 is coupled to the second box 120, the second portion 122*b* of the second side wall 122 of the second box 120 may be accommodated in the first accommodation portion 1101 of the first box 110. Thus, the first side wall 112 of the first box 110 and the first portion 122*a* of the second side wall 122 of the second box 120 may define a stepless coplanar plane. According to an embodiment, the second box 120 may also be fabricated in a manner in which at least two sheets of paper are laminated, punched out in the form of a spread sheet, and then folded.

According to various embodiments, the package box assembly 100 may include a hanger 220 disposed in at least a partial area of the first accommodation portion 1101 of the first box 110. According to an embodiment, the hanger 220 may be accommodated in the first accommodation portion 1101 of the first box 110 and may at least partially protrude by a user to hang on an exhibition stand for sale and/or exhibition purposes. According to an embodiment, the first box 110 may include a sealing tape 131 attached to at least a partial area of the first side wall 112 and a sealing member 1311 connected to be partially detachable from the sealing tape 131. According to an embodiment, the sealing member 1311 may be connected via a guide line 1311*a* (e.g., a guide groove or a knife line) to be separated from the sealing tape 131. According to an embodiment, the sealing member 1311 may be configured to be separable from the sealing tape 131 via the guide line 1311*a* when held and pulled outward by a user. According to an embodiment, the sealing member 1311 may be integrally made of the same material as the sealing tape 131, or may be made of a material different from that of the sealing tape 131. According to an embodiment, the guide line 1311*a* may include a cutting line (e.g., a knife line) having a predetermined depth from the outer surface of the sealing tape 131.

According to various embodiments, when the sealing member 1311 is removed by a user, the hanger 220 may at least partially protrude through the opening 1102 provided in an area of the first side surface 112 corresponding to the sealing member 1311. According to an embodiment, the hanger 220 may be disposed in the first accommodation portion 1101 of the first box 110 in the state of being pushed outward (e.g., toward the opening 210 and may at least partially protrude through the opening 1102 through removal of the sealing member 1311. For example, when protruding to the outside of the first box 110, the hanger 220 may change the package box assembly 100 to a state in which the package box assembly 100 is capable of hanging on an exhibition stand by using the hanging portion 221. According to an embodiment, the hanger 220 may protrude from the first box 110 in a state in which the first box 110 and the second box 120 are assembled.

According to an embodiment of the disclosure, when a predetermined number of package box assemblies 100 are accommodated in a carton for logistics distribution or palletizing, through the hanger accommodation structures accommodated in the first boxes, unnecessary dead space is excluded, thereby helping improve loading efficiency and reduce manufacturing costs.

Figure 2:
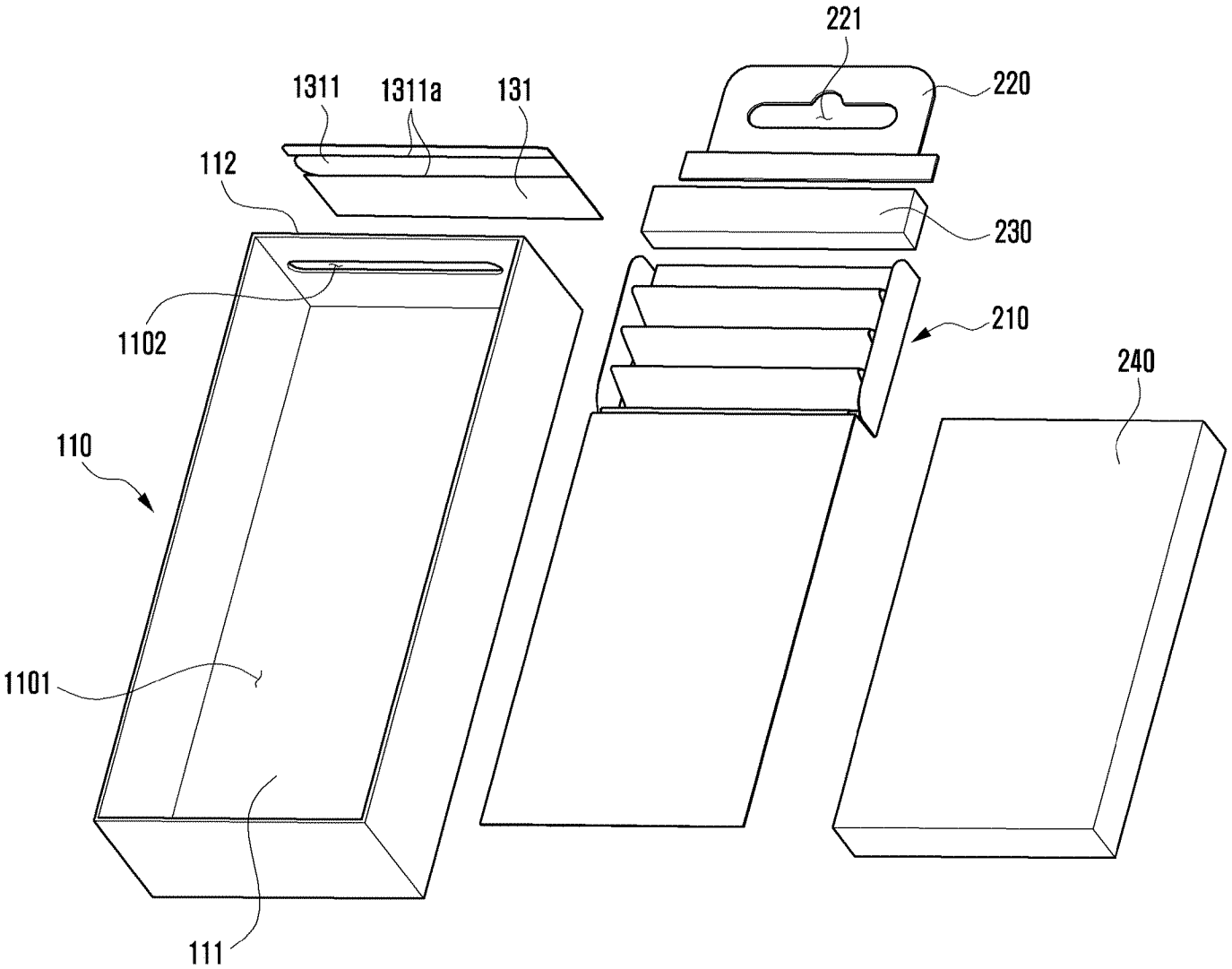
FIG. 2 is an exploded perspective view of a first box according to an embodiment of the disclosure.

FIG. 2 is an exploded perspective view of a first box according to an embodiment of the disclosure.

Referring to FIG. 2, a first box 110 may include a first accommodation portion 1101 defined by a first plate 111 and a first side wall 112 disposed long the periphery of the first plate 111 and having a predetermined height. According to an embodiment, the first box 110 may include an elastic member 210 disposed in the first accommodation portion 1101, a hanger 220 fixed to at least a portion of the elastic member 210, a hanger support 230 disposed in at least a portion of the elastic member 210 and configured to support the hanger 220, and a sealing member 131 including a sealing member 1311 attached to the outer surface of the first side wall 112 to cover an opening 1102 provided in the first side wall 112. In some embodiments, the elastic member 210 and the hanger support 230 may be integrated. In some embodiments, the hanger 220 and the hanger support 230 may be integrated. In some embodiments, the sealing member 1311 may include a tape member attached to the outer surface of the first box 110 alone without the sealing tape 131. In this case, the sealing member 1311 may be attached through an adhesive having an adhesive force that is easily detachable from the outer surface of the first box 110. According to an embodiment, the hanger 220 may be fabricated through lamination of at least two sheets of paper having a predetermined thickness. According to an embodiment, the hanger support 230 may also be fabricated through lamination of at least two sheets of paper having a predetermined thickness. According to an embodiment, the elastic member 210 to which the hanger 220 is attached may be at least partially disposed in the first accommodation portion 1101 of the first box 110 and may further include an auxiliary box 240 disposed on at least a portion of the elastic member 210 in the first accommodation portion 1101. According to an embodiment, the auxiliary box 240 may include various additional elements such as a service manual booklet for the electronic device packaged in the package box assembly 100.

Figure 3A:
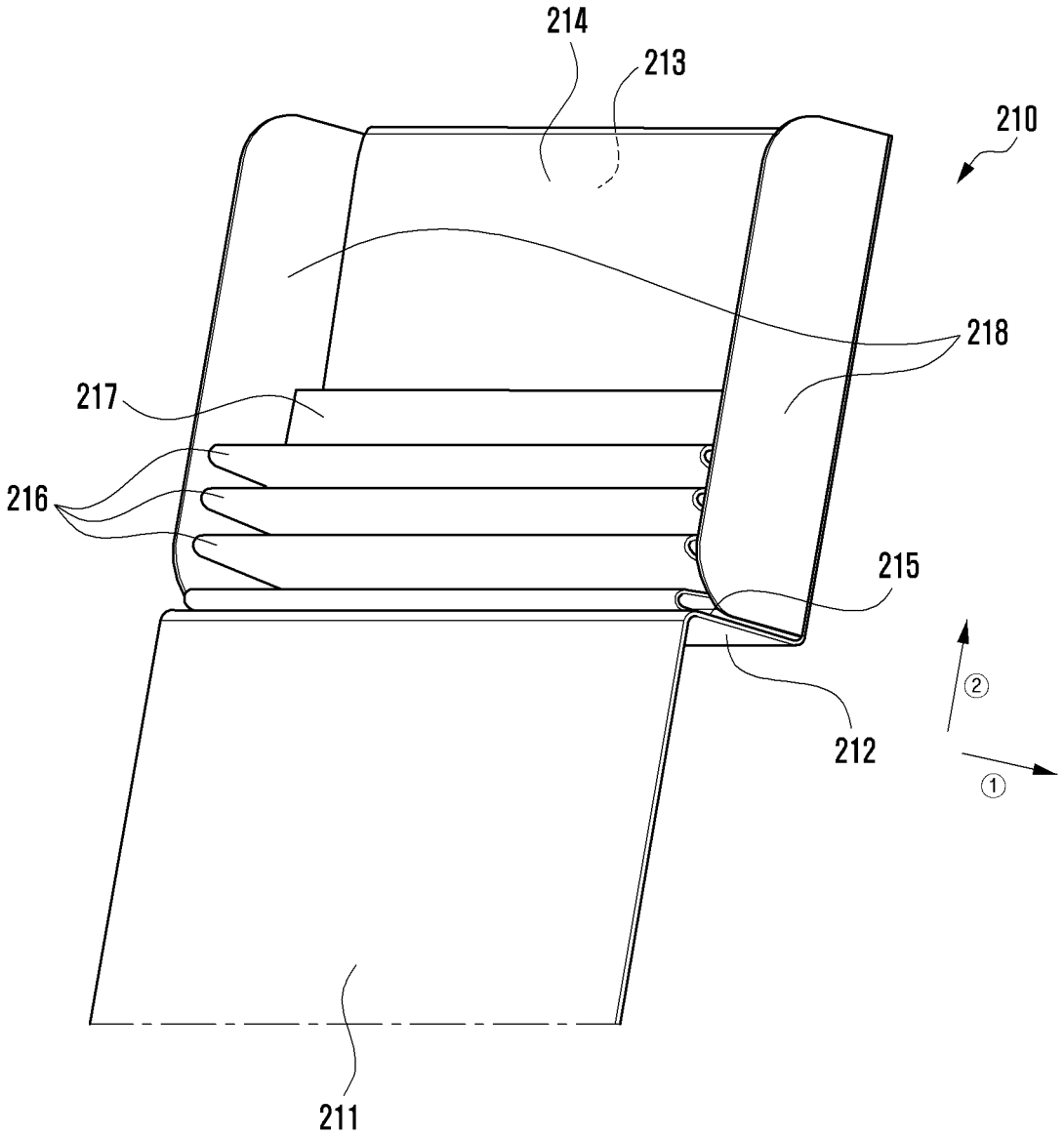
FIG. 3A is a perspective view of an elastic member according to an embodiment of the disclosure.
Figure 3B:
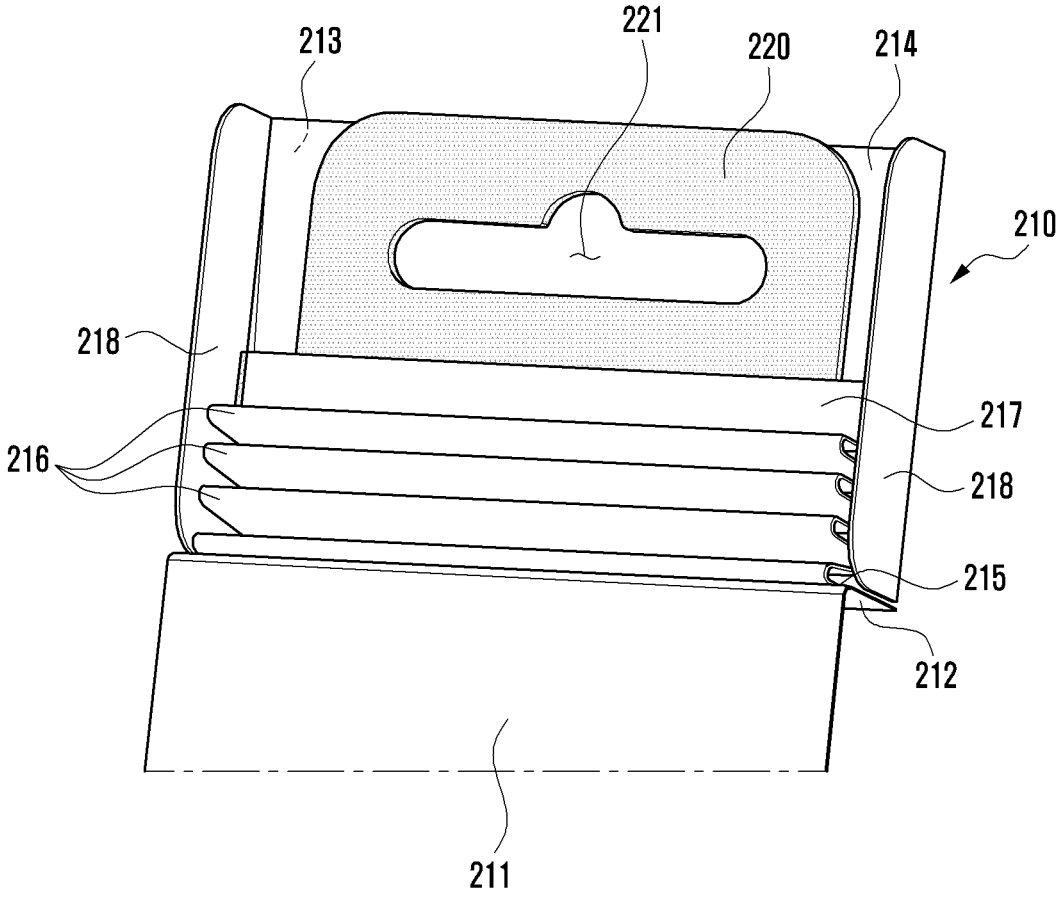
FIG. 3B is a perspective view illustrating a portion of the elastic member in a state in which the hanger is attached according to an embodiment of the disclosure.
Figure 3C:
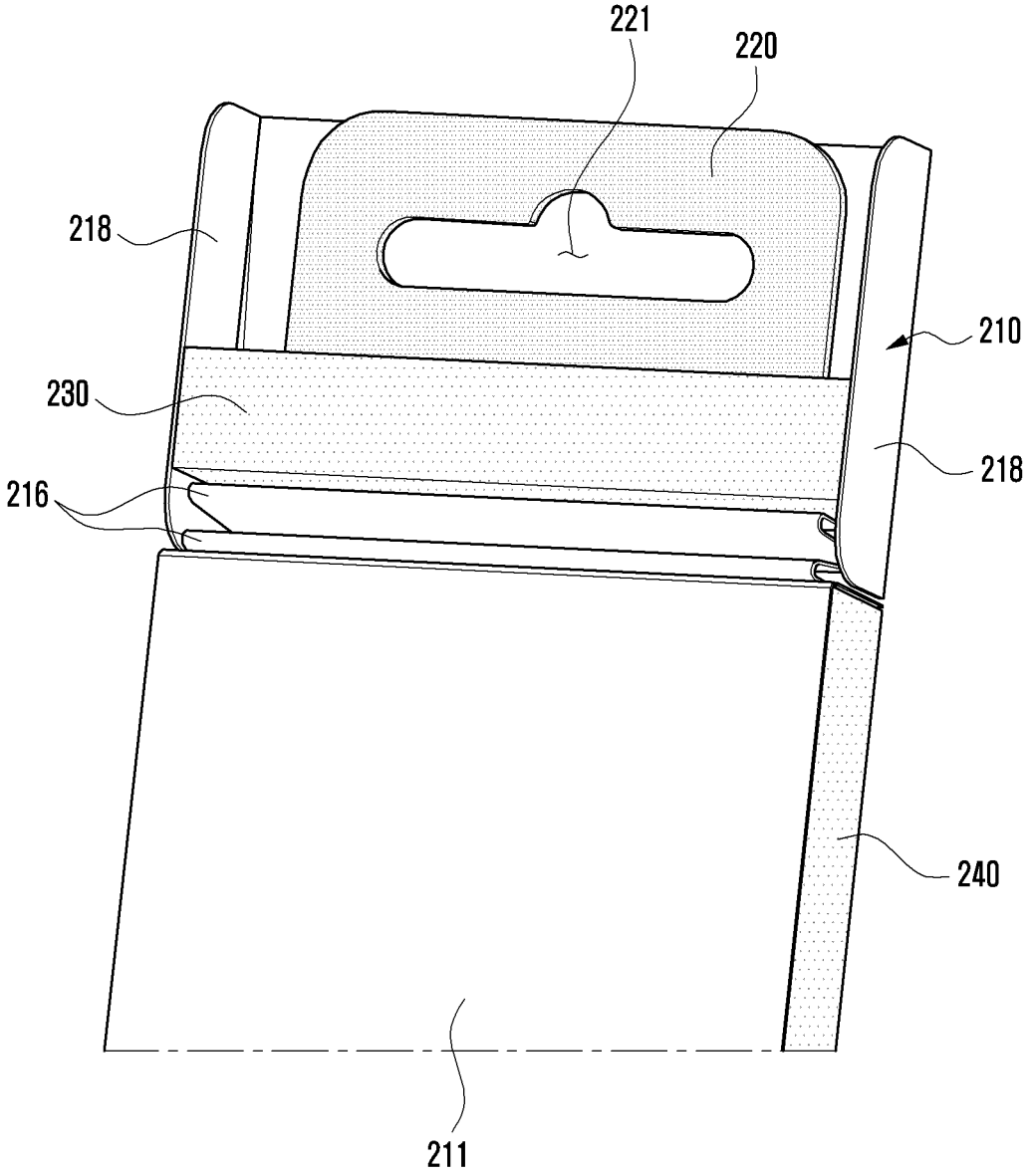
FIG. 3C is a perspective view illustrating a portion of the elastic member in a state in which the hanger and an auxiliary box are disposed according to an embodiment of the disclosure.
Figure 3D:
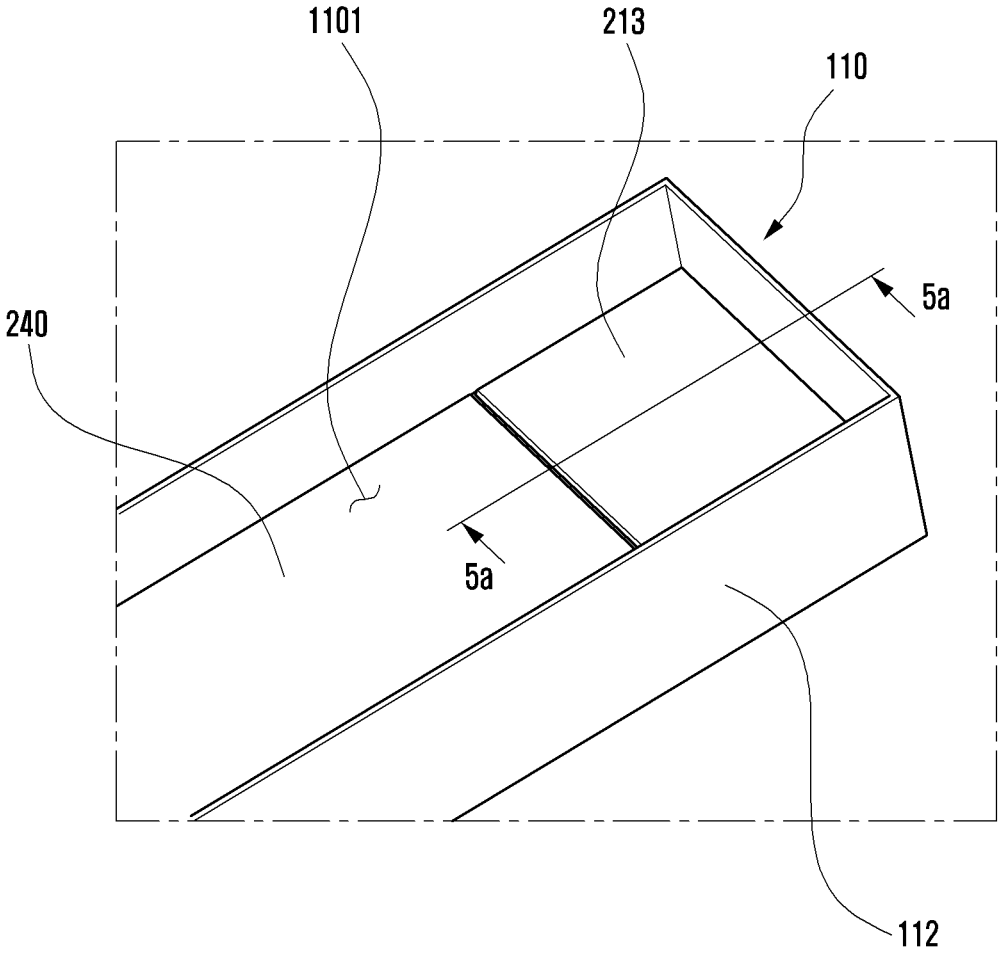
FIG. 3D is a perspective view illustrating a portion a first box in a state in which the elastic member and the auxiliary member are assembled according to an embodiment of the disclosure.
Figure 4:
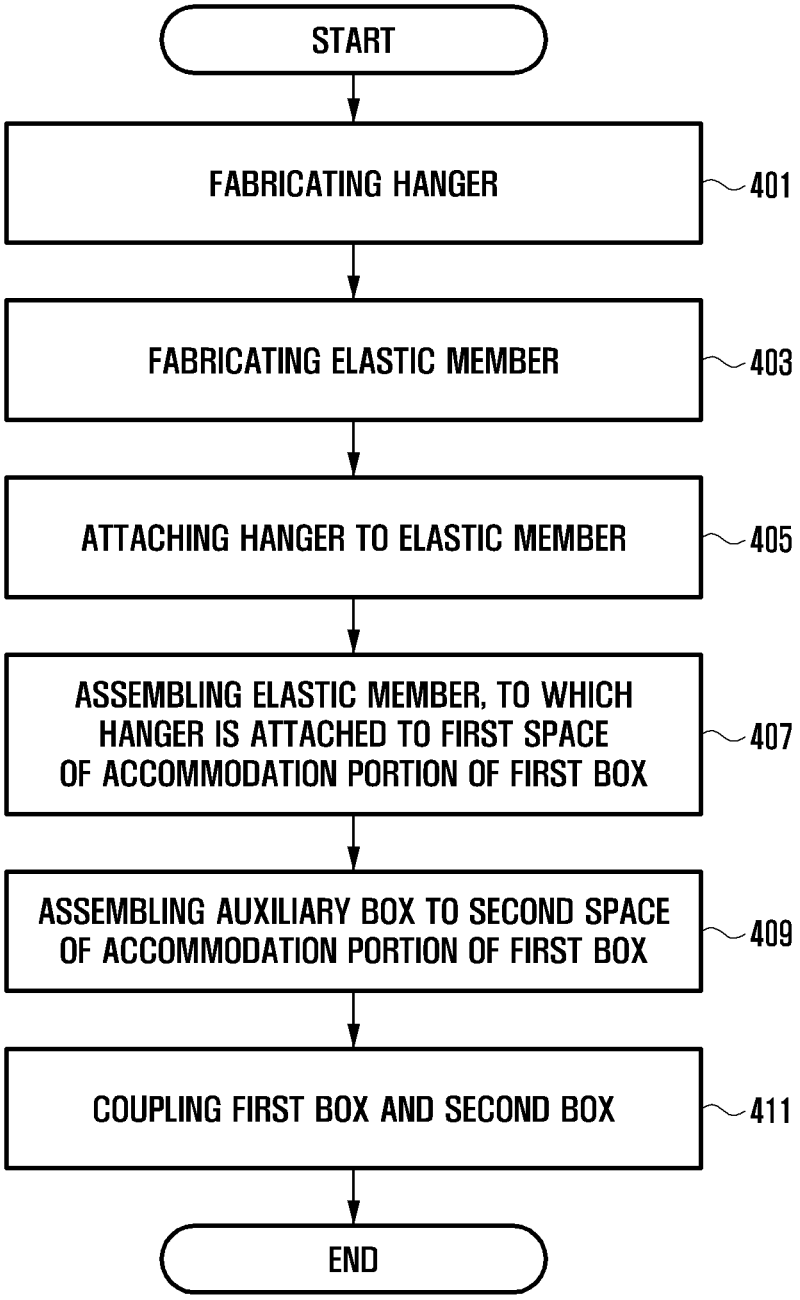
FIG. 4 is a flowchart illustrating a coupling sequence of the package box assembly according to an embodiment of the disclosure.

FIGS. 3A, 3B, 3C, and 3D are views illustrating configurations of assembly structures of the first box according to various embodiments of the disclosure, and FIG. 4 is a flowchart illustrating a coupling sequence of the package box assembly according to an embodiment of the disclosure.

Referring to the process sequence of FIG. 4 with reference to FIGS. 3A to 3D, the hanger 220 may be fabricated in operation 401. For example, the hanger 220 may have a predetermined thickness and may be fabricated in such a way that at least two sheets of paper are laminated, punched out in the form of a spread sheet, and assembled. According to an embodiment, when protruding to the outside of the first box 110, the hanger 220 may include a hanging portion 221 configured to hang the package box assembly 100 on an exhibition stand or a stall.

Then, in operation 403, the elastic member 210 may be fabricated. FIG. 3A is a perspective view of an elastic member according to various embodiments of the disclosure. The elastic member 210 may also have a predetermined thickness and may be fabricated in such a way that at least two sheets of paper are laminated, punched out in the form of a spread sheet, and assembled. According to an embodiment, the elastic member 210 may include an attachment portion 211 attached to at least a portion of the first plate 111 of the first box 110 in the first accommodation portion 1101 of the first box 110, a first bent portion 212 bent from the attachment portion 211 by a predetermined length in a first direction (direction ①) perpendicular to the attachment portion 211, a second bent portion 213 extending from the first bent portion 212 in a second direction (direction ②) perpendicular to the first direction (direction ①) and away from the first bent portion 212, a third bent portion 214 extending to be folded from the second bent portion 213 in a direction opposite to the second direction (direction ②), a fourth bent portion 215 bent from the third bent portion 214 in a direction opposite to the first direction (direction ①), an elastic portion 216 folded from the fourth bent portion 215 multiple times in opposite directions along the second direction (direction ②), and a hanger attachment portion 217 extending from the elastic portion 216 and configured such that at least a portion of the hanger 220 is attached thereto. According to an embodiment, the elastic portion 216 may be folded based on several axes. For example, the elastic portion 216 may have a bellows shape (e.g., in the form of a corrugated plate) alternately folded in opposite directions and may be configured to have elasticity along the second direction (direction ②) by the folded structure.

According to various embodiments, the elastic member 210 may further include side surface portions 218 extending from opposite side surfaces of the second bent portion 211 to cover at least the elastic portion 216. According to an embodiment, the side surface portions 218 may have a height substantially equal to the bent length of the first bent portion 212. In some embodiments, the side surface portions 218 may extend from the third bent portion 214. In this case, the height of the side portions 218 may be substantially equal to the bent length of the fourth bent portion 215. According to an embodiment, the side surface portions 218 may assist the operation of the elastic portion 216, and when the elastic member 210 is assembled to the first accommodation portion of the first box 110, the side surface portions 218 may be used as an operator's gripping portions.

Then, in operation 405, the hanger 220 may be attached to the elastic member 210. FIG. 3B is a perspective view of a portion of the elastic member in a state in which the hanger is attached according to an embodiment of the disclosure, in which the hanger 220 may be attached to the hanger attachment portion 217 via an adhesive member (e.g., adhesive or adhesive tape). In some embodiments, the hanger 220 may be coupled to the hanger attachment portion 217 through structural coupling.

Then, in operation 407, the elastic member 210 to which the hanger 220 is attached may be assembled to the first accommodation portion 1101 of the first box 110. According to an embodiment, a user may place the elastic member 210 in a partial space of the accommodation portion 1101 of the first box 110 while holding the side surface portions 218 of the elastic member 210. In this case, the attachment portion 211 of the elastic member 210 may be attached to the first plate 111 of the first box 110 via an adhesive member (e.g., adhesive tape or adhesive). According to an embodiment, since it is necessary to move the elastic member 210 relative to the attachment portion 211, the elastic member 210 may be in a state of being non-fixed to the first accommodation portion 1101 of the first box 110.

Then, in operation 409, the auxiliary box 240 may be assembled to the first accommodation portion 1101 of the first box 110. FIG. 3C is a perspective view illustrating a portion of the elastic member in a state in which the hanger and the auxiliary box are disposed according to an embodiment of the disclosure, and FIG. 3D is a perspective view illustrating a portion of the first box in a state in which the elastic member and the auxiliary member are assembled according to an embodiment of the disclosure, in which the auxiliary box 240 may include a manual booklet of an electronic device or the like. According to an embodiment, when the auxiliary box 240 is assembled, in the first accommodation portion 1101 of the first box 110, the auxiliary box 240 and the second bent portion 2103 of the elastic member 210 may define a coplanar plane to easily accommodate a product such as an electronic device thereon.

Thereafter, in operation 411, the package box assembly 100 may be completed by assembling the second box 120 and the first box 110 in a state in which the electronic device is accommodated in the first accommodation portion 1101 of the first box 110. In this case, the hanger 220 may be in a state of being accommodated in the first accommodation portion 1101 of the first box 110 and may not protrude outward through the sealing tape 131 including the sealing member 1311.

Figure 5A:
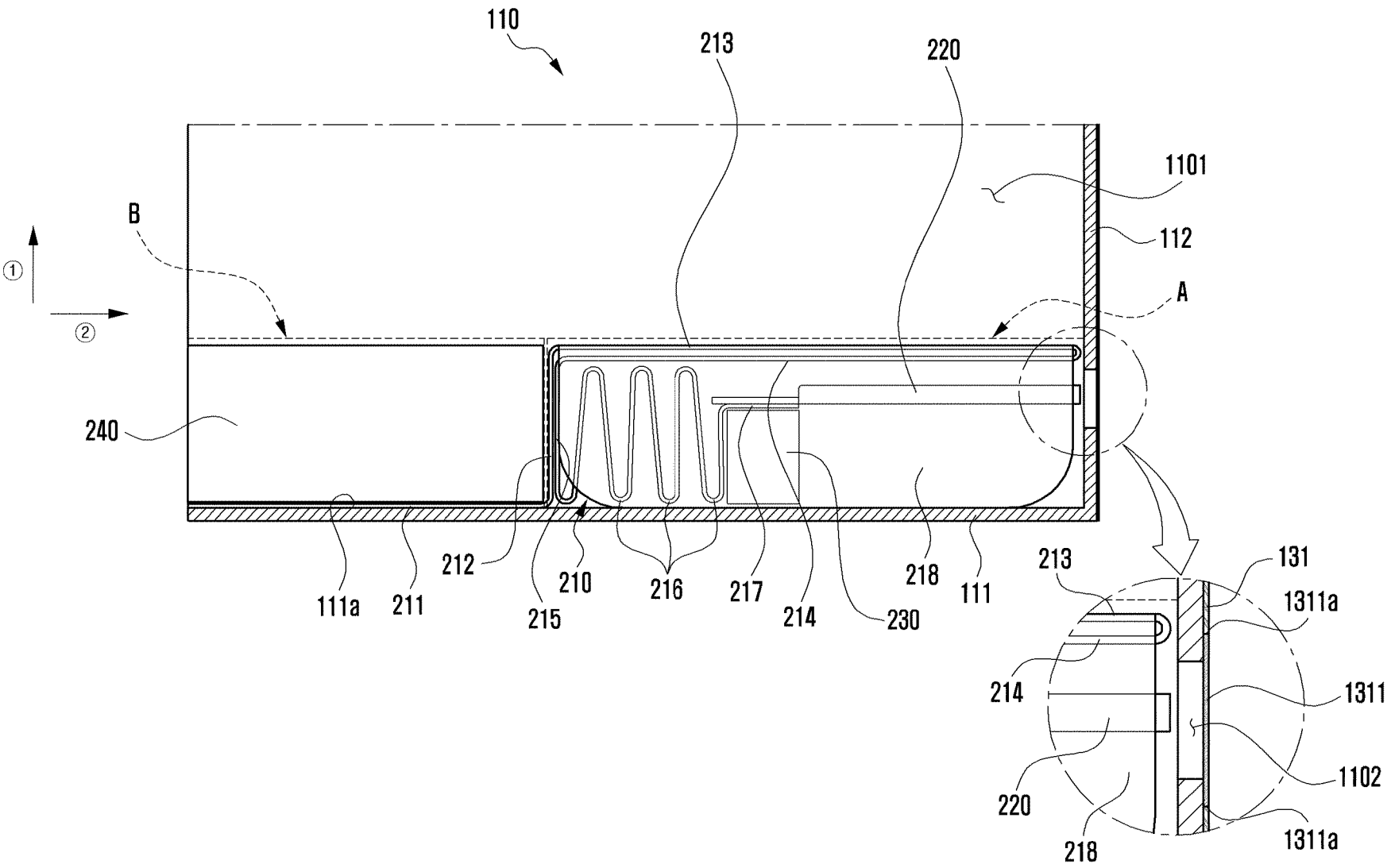
FIG. 5A is a cross-sectional view of a portion of the first box taken along line 5*a*-5*a* of FIG. 3D according to an embodiment of the disclosure.
Figure 5B:
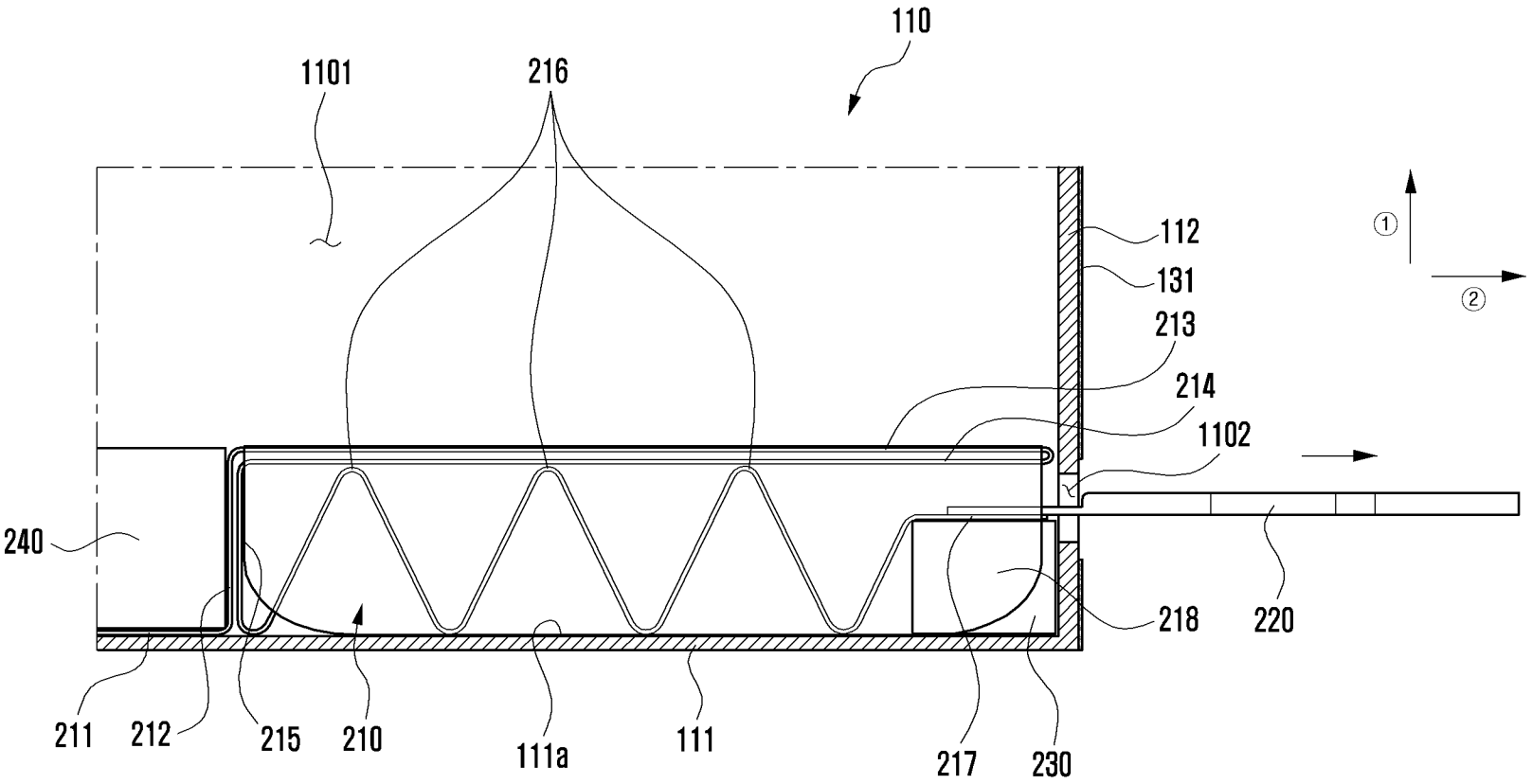
FIG. 5B is a cross-sectional view of a portion of the first box in a state in which the hanger protrudes according to an embodiment of the disclosure.

FIG. 5A is a cross-sectional view of a portion of the first box according to an embodiment of the disclosure taken along line 5*a*-5*a* of FIG. 3D. FIG. 5B is a cross-sectional view of a portion of the first box according to an embodiment of the disclosure in a state in which the hanger protrudes.

Referring to FIG. 5A, the first box 110 may include an elastic member 210 disposed in a partial area (e.g., area A) of the first accommodation portion 1101 defined by the first plate 111 and the first side wall 112. According to an embodiment, the elastic member 210 may be disposed in the first accommodation portion 1101 in such a way that the attachment portion 211 is attached to the inner surface 111*a* of the first plate 111. In this case, in another area (area B) of the first accommodation portion 1101, the auxiliary box 240 may be coupled above the attachment portion 211. According to an embodiment, the elastic member 210 may include a first bent portion 212, a second bent portion 213, a third bent portion 214, a fourth bent portion 215, and an elastic portion 216, which integrally extend from the attachment portion 211 to predetermined lengths and in predetermined directions, and the hanger 220 may be fixed via a hanger attachment portion 217 extending to the end of the elastic portion 216. In this case, the hanger 220 may be maintained in the state of being pushed by the elastic portion 216 in the second direction (direction ②).

According to various embodiments, the elastic member 216 may include a hanger support 230 disposed between the hanger attachment portion 217 and the inner surface 111*a* of the first 111. According to an embodiment, the hanger support 230 may provide an engagement structure configured to prevent the hanger 220 attached to the hanger attachment portion 217 from drooping out of alignment with the opening 1102 due to its own weight, to guide the hanger 220 to protrude from the opening 1102 via the elastic member 216, and to prevent the hanger 220 from being completely separated into the opening 1102. According to an embodiment, the hanger support 230 may also be made of paper, and may move together with the elastic portion 216 by being attached to the hanger attachment portion 217.

According to various embodiments, the first box 110 may include a sealing tape 131 attached to the outer surface of the first side wall 112. According to an embodiment, the sealing tape 131 may include a sealing member 1311 disposed at a position corresponding to the opening 1102 provided in the first side wall 112. The sealing member 1311 may be maintained in a state of being connected to the sealing tape 131 to be easily separated via a guide line (e.g., the guide line 1311*a* of FIG. 1A). According to an embodiment, the opening 1102 may be placed at a position corresponding to the hanger 220 disposed in the first accommodation portion 1101. According to an embodiment, the hanger 220 is in the state of being pushed by the elastic member 210 in the second direction (direction ②) but may be maintained in the state of not protruding to the outside by the sealing member 210 attached to the first side wall 1120. Through the structure of storing the hanger 220 inside, the package box assembly (e.g., the package box assembly 100 of FIG. 1A) may be improved in loading efficiency during palletizing, thereby resulting in reduction of manufacturing costs.

Referring to FIG. 5B, after the logistics movement of the package box assembly 100 is completed, when the sealing member 1311 is removed from the first side wall 112 of the first box 110 for the purpose of selling or displaying on an exhibition stand or a stall, the opening 1102 may be exposed to the outside. In this case, by being at least partially protruding through the opening 1102 by the pushing force of the elastic member 210, the hanger 220 may be changed into a state of hanging on a display stand or a stall via the hanging portion 221.

Figure 6:
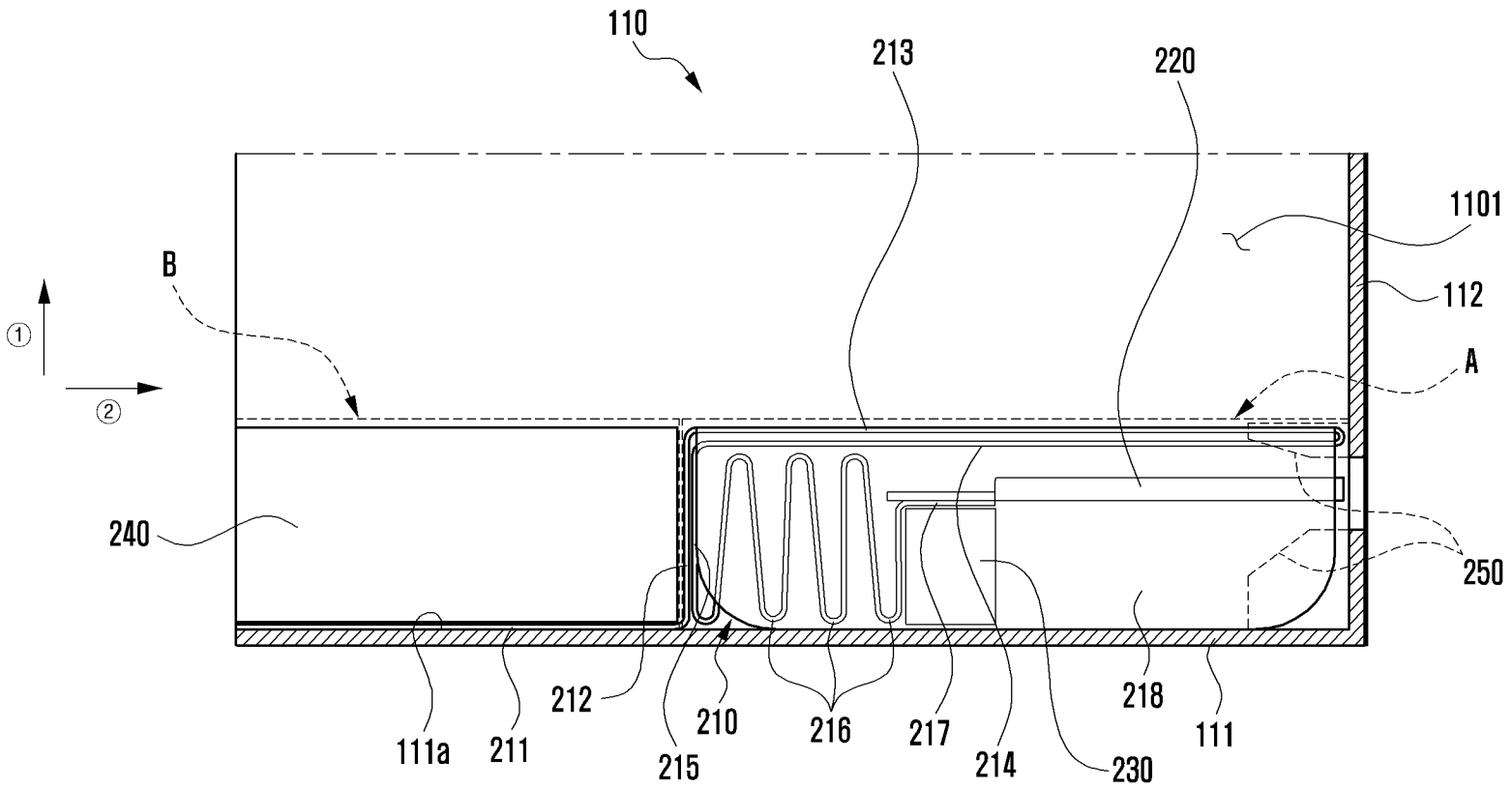
FIG. 6 is a cross-sectional view of a portion of a first box including a hanger according to an embodiment of the disclosure.

FIG. 6 is a cross-sectional view of a portion of a first box including a hanger according to an embodiment of the disclosure.

In describing the first box 110 of FIG. 6, the same reference numerals are assigned to substantially the same components as those of the first box 110 of FIG. 5A, and a detailed description thereof may be omitted.

Referring to FIG. 6, the first box 110 may further include at least one hanger guide block 250 disposed in the first accommodation portion 1101. According to an embodiment, the at least one hanger guide block 250 may have a shape tapered to converge toward the opening 1102 in order to guide the hanger 220 to the opening 1102. According to an embodiment, the at least one hanger guide block 250 may also be made of paper.

In some embodiments, the elastic member 210 may directly extend from the attachment portion 211 to the elastic portion 216 without the first bent portion 212 to the fourth bent part 215. In some embodiments, the elastic member 210 may be replaced with at least one coil spring or leaf spring disposed in the first accommodation portion 1101 and configured to push the hanger 220 toward the opening 1102 (e.g., in the second direction (direction ②)).

According to various embodiments, a package box assembly (e.g., the package box assembly 100 in FIG. 1A) may include a first box (e.g., the first box 110 in FIG. 1A) including an accommodation portion (e.g., the first accommodation portion 1101 in FIG. 1A) defined by a plate (e.g., the first plate 111 in FIG. 1A) and a side wall (e.g., the first side wall 112) disposed to surround the plate along the periphery of the plate and having a predetermined height (e.g., the first side wall 112 in FIG. 1A), a second box (e.g., the second box 120 in FIG. 1A) at least partially accommodated in the accommodation portion, a hanger (e.g., the hanger 220 in FIG. 1C) disposed in a first space in the accommodation portion to at least partially protrude through an opening (e.g., the opening 1102 in FIG. 1C) provided in the side wall, an elastic member (e.g., the elastic member 210 in FIG. 6) disposed in the first space to press the hanger toward the opening, and a sealing member (e.g., the sealing member 1311 in FIG. 1B) removably disposed on the side wall to seal the opening. The hanger may be accommodated in the first space through the sealing member while being pushed by the elastic member, and when the sealing member is removed, the hanger may at least partially protrude to the outside of the first box through the opening by the pushing force of the elastic member.

According to various embodiments, the hanger may include a hanging portion provided in a portion protruding to the outside of the first box.

According to various embodiments, the hanger may be fabricated by laminating at least two sheets of paper having a predetermined thickness.

According to various embodiments, the first space may be separated from a surrounding second space in the accommodation portion.

According to various embodiments, the package box assembly may further include an auxiliary box disposed in the second space.

According to various embodiments, the elastic member may be fabricated by laminating at least two sheets of paper having a predetermined thickness.

According to various embodiments, the elastic member may include an attachment portion attached to at least a portion of the plate in the accommodation portion, a first bent portion bent by a predetermined length in a first direction perpendicular to the attachment portion, a second bent portion extending from the first bent portion in a second direction perpendicular to the first direction and away from the bent portion, a third bent portion extending from the second bent portion to be folded in a direction opposite to the second direction, a fourth bent portion bent in a direction opposite to the first direction from the third bent portion, an elastic portion folded multiple times in opposite directions along the second direction from the fourth bent portion, and a hanger attachment portion extending from the elastic portion and configured such that at least a portion of the hanger is attached thereto.

According to various embodiments, the hanger may be disposed in the second space at a height corresponding to the opening via the hanger attachment portion.

According to various embodiments, the package box assembly may further include a hanger support disposed between the hanger attachment portion and the plate and configured to support the hanger to correspond to the opening.

According to various embodiments, the package box assembly may further include a side surface portion extending from opposite side surfaces of the second bent portion and/or the third bent portion to cover at least the elastic portion.

According to various embodiments, the side surface portion may have a height substantially equal to a bent length of the first bent portion.

According to various embodiments, the side surface portion may have a height substantially equal to a bent length of the fourth bent portion.

According to various embodiments, the sealing member may be included in at least a portion of the sealing tape attached to the side wall to include the opening, and may be disposed to be separable via a guide line disposed around an area corresponding to the opening.

According to various embodiments, the guide line may include a cutting line having a predetermined depth in the sealing tape.

According to various embodiments, the package box assembly may further include at least one hanger guide block disposed around the opening in the first space and having a shape configured to guide the hanger to the opening.

According to various embodiments, the hanger guide block may have a shape tapered to converge toward the opening in order to guide the hanger to the opening.

According to various embodiments, the elastic member may include at least one of a coil spring or a plate spring configured to push the hanger toward the opening in the first space.

According to various embodiments, the first box is configured to accommodate the second box in the accommodation portion by a predetermined depth by means of an engagement step provided on the outer surface of the second box, and the first space may be disposed at a position where the first space is not interfered with by the second box accommodated in the accommodation portion.

According to various embodiments, the first space may be determined by an accommodation depth of the accommodation portion configured to accommodate the second box.

According to various embodiments, the first box and/or the second box may be made of a paper material.

While the disclosure has been shown and described with reference to various embodiments thereof, it will be understood by those skilled in the art that various changes in form and details may be made therein without departing from the spirit and scope of the disclosure as defined by the appended claims and their equivalents.

What is claimed is:

1. A package box assembly comprising:

a first box comprising an accommodation portion defined by a plate and a side wall disposed to surround the plate along a periphery of the plate and having a predetermined height;

a second box at least partially accommodated in the accommodation portion;

a hanger disposed in a first space in the accommodation portion to at least partially protrude through an opening provided in the side wall;

an elastic member disposed in the first space to press the hanger toward the opening; and a sealing member removably disposed on the side wall to seal the opening, wherein the hanger is accommodated in the first space through the sealing member while being pushed by pressure from the elastic member, and wherein in case that the sealing member is removed, the hanger at least partially protrudes to outside of the first box through the opening by a pushing force of the elastic member.

2. The package box assembly of claim 1, wherein the hanger comprises a hanging portion provided in a portion protruding to the outside of the first box.

3. The package box assembly of claim 1, wherein the hanger is fabricated by laminating at least two sheets of paper having a predetermined thickness.

4. The package box assembly of claim 1, wherein the first space is separated from a surrounding second space in the accommodating portion.

5. The package box assembly of claim 4, further comprising:

an auxiliary box disposed in the second space.

6. The package box assembly of claim 1, wherein the elastic member is fabricated by laminating at least two sheets of paper having a predetermined thickness.

7. The package box assembly of claim 1, wherein the elastic member comprises:

an attachment portion attached to at least a portion of the plate in the accommodation portion;

a first bent portion bent by a predetermined length in a first direction perpendicular to the attachment portion;

a second bent portion extending from the first bent portion in a second direction perpendicular to the first direction and away from the bent portion;

a third bent portion extending from the second bent portion to be folded in a direction opposite to the second direction;

a fourth bent portion bent in a direction opposite to the first direction from the third bent portion;

an elastic portion folded multiple times in opposite directions along the second direction from the fourth bent portion; and a hanger attachment portion extending from the elastic portion and configured such that at least a portion of the hanger is attached thereto.

8. The package box assembly of claim 7, wherein the hanger is disposed in a second space at a height corresponding to the opening via the hanger attachment portion.

9. The package box assembly of claim 8, further comprising:

a hanger supporter disposed between the hanger attachment portion and the plate and configured to support the hanger to correspond the opening.

10. The package box assembly of claim 7, further comprising:

a side surface portion extending from opposite side surfaces of the second bent portion and/or the third bent portion to cover at least the elastic portion.

11. The package box assembly of claim 10, wherein the side surface portion has a height substantially equal to a bent length of the first bent portion.

12. The package box assembly of claim 10, wherein the side surface portion has a height substantially equal to a bent length of the fourth bent portion.

13. The package box assembly of claim 1, wherein the sealing member is included in at least a portion of sealing tape attached to the side wall to comprise the opening, and wherein the sealing member is disposed to be separable via a guide line disposed around an area corresponding to the opening.

14. The package box assembly of claim 13, wherein the guide line comprises a cutting line having a predetermined depth in the sealing tape.

15. The package box assembly of claim 1, further comprising:

at least one hanger guide block disposed around the opening in the first space and having a shape configured to guide the hanger to the opening.

16. The package box assembly of claim 15, wherein the hanger guide block has a shape tapered to converge toward the opening in order to guide the hanger to the opening.

17. The package box assembly of claim 1, wherein the elastic member includes at least one of a coil spring or a plate spring configured to push the hanger toward the opening in the first space.

18. The package box assembly of claim 1, wherein the first box is configured to accommodate the second box in the accommodation portion by a predetermined depth by means of an engagement step provided on the outer surface of the second box, and wherein the first space is disposed at a position where the first space is not interfered with by the second box accommodated in the accommodation portion.

19. The package box assembly of claim 18, wherein the first space is determined by an accommodation depth of the accommodation portion configured to accommodate the second box.

20. The package box assembly of claim 1, wherein the first box and/or the second box is made of a paper material.

* * * * *